US007502578B2

(12) United States Patent
Wada et al.

(10) Patent No.: US 7,502,578 B2
(45) Date of Patent: Mar. 10, 2009

(54) ELECTROPHOTOGRAPHIC DEVELOPMENT APPARATUS

(75) Inventors: Minoru Wada, Kawanishi (JP); Eiji Gyoutoku, Itami (JP)

(73) Assignee: Kyocera Mita Corporation (JP)

( * ) Notice: Subject to any disclaimer, the term of this patent is extended or adjusted under 35 U.S.C. 154(b) by 397 days.

(21) Appl. No.: 11/363,485

(22) Filed: Feb. 27, 2006

(65) Prior Publication Data

US 2006/0204281 A1 Sep. 14, 2006

(30) Foreign Application Priority Data

Feb. 28, 2005 (JP) ..... 2005-054992

(51) Int. Cl.
*G03G 15/08* (2006.01)

(52) U.S. Cl. ..... 399/260; 399/281

(58) Field of Classification Search ..... 399/227, 399/260, 272, 281

See application file for complete search history.

(56) References Cited

U.S. PATENT DOCUMENTS 4,699,495 A * 10/1987 Hilbert ..... 399/234
5,943,537 A * 8/1999 Ahn ..... 399/254
6,438,344 B1 * 8/2002 Fujimoto ..... 399/254
6,871,033 B2 * 3/2005 Sato et al. ..... 399/260
7,321,743 B2 * 1/2008 Kimura et al. ..... 399/227

FOREIGN PATENT DOCUMENTS

JP 63195676 A * 8/1988
JP 04186267 A * 7/1992
JP 05053434 A * 3/1993
JP 2000098719 A * 4/2000
JP 2003-255687 A 9/2003
JP 2003302821 A * 10/2003

* cited by examiner

*Primary Examiner*—Robert Beatty

(57) ABSTRACT

An object of the present invention is to provide a small-sized developing apparatus which well supplies the developer, does not cause the image degradation for a long term. The developing apparatus comprises a developer containing chamber, a developer supply chamber and developing means which is disposed in said developer supply chamber and develops an electrostatic latent image, a boundary wall which is disposed between said developer containing chamber and said developer supply chamber and has a first and a second opening, and an opening and closing member for opening and closing said first opening. The single component developer is supplied through said second opening into the developer supply chamber. The opening and closing member opens and closes, in response to the toner quantity supplied into the toner supply chamber and allows said single component developer to move in only one direction from said developer supply chamber to said developer containing chamber.

8 Claims, 6 Drawing Sheets

ELECTROPHOTOGRAPHIC DEVELOPMENT APPARATUS

BACKGROUND OF THE INVENTION (1) Field of the Invention

The present invention relates to an electro-photographic development apparatus employed in electro-photographic image forming apparatuses such as copiers, printers, and facsimiles, particularly to electro-photographic development apparatus using a single component developer.

(2) Description of the Prior Art

In a developing apparatus using a single component developer (toner), in general, the toner is supplied by a toner supply member such as a toner supply roller to a toner retaining member such as a developing roller. The toner layer thickness on the developing roller is adjusted by a toner layer thickness regulating member and the toner is electrically charged by the regulating member. The toner thin layer on the developing roller comes close to or into contact with an image retaining member such as a photoreceptor drum, thereby developing an electrostatic latent image on the image retaining member.

When the toner layer thickness regulating member contacts the developing roller surface, larger-sized toners are separated away from the developing roller and smaller-sized toners are consumed first for the development, thereby gradually degrading the image quality.

Accordingly, the developing apparatus is divided into two chambers (a toner container and a toner supply unit), thereby additionally supplying the toner supply unit with the toners in the toner container in order to prevent the increase in the larger-sized toners.

Concretely, an opening is formed in a wall between the toner container and the toner supply unit. The increase in the larger-sized toner is avoided in such a manner that the opening is opened, only when the toners is introduced from the toner container to the toner supply unit.

However, the two chamber developing apparatus has a disadvantage that the toner supplied from the toner container does not circulate well and stagnates in the toner supply unit, because a lot of the toners is supplied along only one direction from the toner container to the toner supply unit, whereby the rotational load of the toner supply roller is increased and the toner cannot be stably supplied on the developing roller. Further, the toner is not sufficiently electrically charged, thereby possibly causing the image quality degradation such as an increase in a background fog.

Therefore, in order to solve the above-mentioned disadvantage, JP2003-255687A discloses that an opening member between the toner container and the toner supply unit is fixed over the upper end of the opening. Further, a projected portion projected toward the inside of the toner supply unit is provided at the lower free end of the opening, whereby the toner supply from the toner container to the toner supply unit is suppressed, when the toner supply becomes excessive. Concretely, the developing apparatus of JP2003-255687A as shown in FIG. 7 includes the toner container 2 and toner supply unit 1. There is provided between them an opening which has a backward flow prevention valve 9 for preventing the backward flow to the toner container 2 from the toner supply unit 1. Accordingly, the upper portion of the valve 9 is fixed over the upper portion of the opening, while the lower portion of the valve 9 is made free and a projection 10*a* is fixed with the valve at the toner supply unit side. According to the valve 9, the image degradation due to the toner size selection is prevented. The projection 10*a* prevents the over filling-up and the stagnation of the toner which induce insufficient charging by a toner layer regulating member 5 and the torque increase in the developing apparatus.

However, JP2003-255687A has a disadvantage that the projected portion 10*a* may possibly hits the toner supply roller and the opening is not sufficient opened, thereby obstructing the toner supply, if there is not provided a sufficient gap between the projected portion and the toner supply roller.

Particularly, the sufficient gap is hardly guaranteed by JP2003-255687A, when the developing apparatus is to be made small-sized.

SUMMARY OF THE INVENTION

An object of the present invention is to provide a developing apparatus which well supplies the toner, does not cause the image degradation for a long term and moreover can be made small-sized.

The first developing apparatus of the invention has one or more developing units. The developing unit comprises: a developer containing chamber for containing a single component developer; a developer supply chamber which is supplied with the single component developer in the developer containing chamber; developing means which is disposed in the developer supply chamber and develops an electrostatic latent image on one or more image retaining members by the single component developer; a boundary wall, disposed between the developer containing chamber and the developer supply chamber, which has a first and a second opening; and an opening and closing member for opening and closing the first opening. In the developing apparatus, the single component developer is supplied, through the second opening, from the developer containing chamber into the developer supply chamber; and the opening and closing member opens and closes, in response to a developer quantity supplied into the developer supply chamber and allows the single component developer to move only in a direction from the developer supply chamber to the developer containing chamber.

The second developing apparatus of the invention further comprises a rotation unit for rotating the one or more developing units, the one or more developing units are positioned, by the rotation unit, at a developing position which faces each of the one or more image retaining members.

In the third developing apparatus of the invention, the developing means comprises: a developing roller for developing the electrostatic latent image; and a supply roller for supplying the developing roller with the single component developer, and the first opening is formed, relative to the second opening, at a downstream side of a rotation direction of the supply roller.

In the fourth developing apparatus of the invention, the second opening is formed under a center of a rotation axis of the supply roller; and the first opening is formed over an uppermost point of an outer surface of the supply roller.

The fifth developing apparatus of the invention further comprises a stirring member disposed in the developer containing chamber, wherein a center of a rotation axis of the stirring member is positioned over the second opening.

In the sixth developing apparatus of the invention, the boundary wall has a partial portion formed along an outer surface of the supply roller and the second opening is formed at the partial portion.

In the seventh developing apparatus of the invention, the opening and closing member is an elastic or flexible member disposed in the developer containing chamber; an end of the elastic or flexible member is fixed with the boundary wall; and another end of the elastic or flexible member is free.

In the eighth developing apparatus of the invention, the boundary wall has a partial portion along an outer surface of the supply roller; the second opening is provided at the partial portion; and contact prevention means for preventing the stirring member from contacting the opening and closing member is provided at the partial portion, under the first opening and over the second opening.

In the ninth developing apparatus of the invention, the contact prevention means is a projection or a step which is provided in the toner containing chamber and is projected toward an inner side of the toner containing chamber.

In the tenth developing apparatus of the invention, a center of the second opening is lower than a rotational axis of the supply roller; an upper end of the first opening is higher than an uppermost point of the supply roller; and a lower end of the first opening is lower than an uppermost point of the supply roller.

According to the present invention, the single component developer is supplied, through the second opening, from the developer containing chamber into the developer supply chamber; and the opening and closing member opens and closes, in response to a developer quantity supplied into the developer supply chamber and allows the single component developer to move only in a direction from the developer supply chamber to the developer containing chamber. Therefore, the excessive toner supply into the toner supply chamber is prevented, because the opening and closing member allows the toner to return only from the toner supply chamber to the toner containing chamber, whereby the toner does not stagnate in the toner supply chamber and the image quality degradation such as the fogging can be avoided.

According to the present invention, in the color copier, printer and so on, the image quality degradation can be avoided.

According to the present invention, the toner exchange between the two chambers can be suppressed, because the first opening is positioned at the downstream side of the second opening along the rotational direction of the toner supply roller. Further, the toner supplied through the second opening does not immediately reach the development roller, thereby preventing the image quality degradation.

According to the present invention, the toner quantity supplied into the toner supply chamber is regulated by the size and shape of the second opening and the gap between the second opening and the supply roller, because the second opening is provided along the outer surface of the supply roller. Accordingly, a quite lot of the toner is not abruptly supplied.

According to the present invention, it is not required to provide a gap between the supply roller and the opening and closing member, because the opening and closing member is provided in the toner containing chamber side, thereby making the developing apparatus further smaller-sized.

According to the present invention, the stirring member does not push up the opening and closing member, thereby preventing the damage of the opening and closing member and therefore preventing the over supply of the toner due to the damage.

DESCRIPTION OF THE PREFERRED EMBODIMENTS

Figure 1:
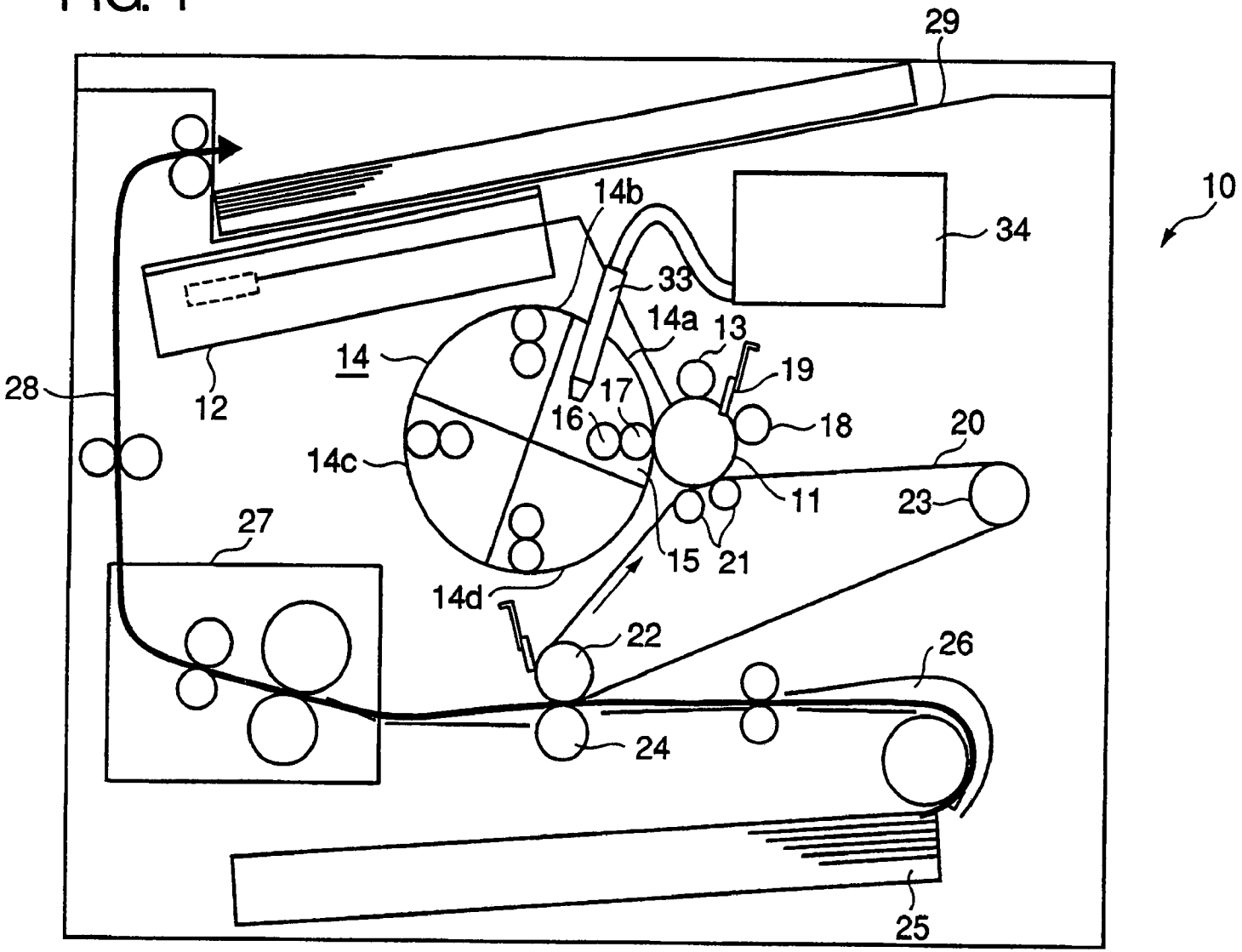
FIG. 1 is a cross sectional view of an image forming apparatus including a developing apparatus of the present invention.

The preferred embodiments are explained, referring to the drawings. It should be understood that the present invention is not limited to specifically described sizes, shapes and relative arrangements of the constituent elements.

FIG. 1 is a cross sectional view of an image forming apparatus 10 including a developing apparatus of the present invention. The image forming apparatus 10 comprises image retaining member such as a photoreceptor drum 11, a laser scanning unit 12, a charging member 13 and a rotating developing apparatus 14 which comprises color developing units 14*a* through 14*d*.

The developing apparatus 14, for example, comprises a black (BK) developing unit 14*a*, a magenta (M) developing unit 14*b*, a cyan (C) developing unit 14*c*, a yellow (Y) developing unit 14*d*, which are provided with housings 15, toner supply rollers 16 of, e.g., urethane sponge of $10^8$ Ω, developing rollers 17 of, e.g., an elastic roller of JIS-A hardness 45 degree, $10^6$ Ω order and of surface roughness Ra (arithmetic average height defined by JIS B0601-2001) 1.0 μm. The nip between the toner supply roller 16 and the developing roller 17 may be e.g., 3 mm. The color developing units 14*a* through 14*d* are rotated by a not-shown drive unit through a not-shown clutch and are sequentially positioned at development positions of the photoreceptor drum 11 in order to develop color electrostatic latent images.

There are provided around the photoreceptor drum 11 a cleaning roller 18, a cleaning blade 19, an intermediate transfer belt 20 contacting the photoreceptor drum 11 and a primary transfer roller 21 opposite to the photoreceptor drum 11 through the intermediate transfer belt 20. The intermediate transfer roller 20 is tensioned by a drive roller 22 and a slave roller 23 and is rotated clockwise as shown by an arrow. Further, a secondary transfer roller 24 is provided opposite to the drive roller 22 through the intermediate transfer belt 20.

The toner image on the photoreceptor drum 11 is transferred on the intermediate transfer belt 20 by the primary transfer roller 21 (the primary transfer). Further, the toner image on the intermediate transfer belt 20 is transferred, at a nip between the drive roller 22 and the secondary transfer roller 24, on a recording member such as a paper carried from a paper supply cassette 25 through a paper supply path 26 (the secondary transfer). Then, the paper is carried to a fixing unit 27 for fixing the toner images thereon and is outputted to a paper outlet tray 29 through a paper outlet path 28.

Figure 2:
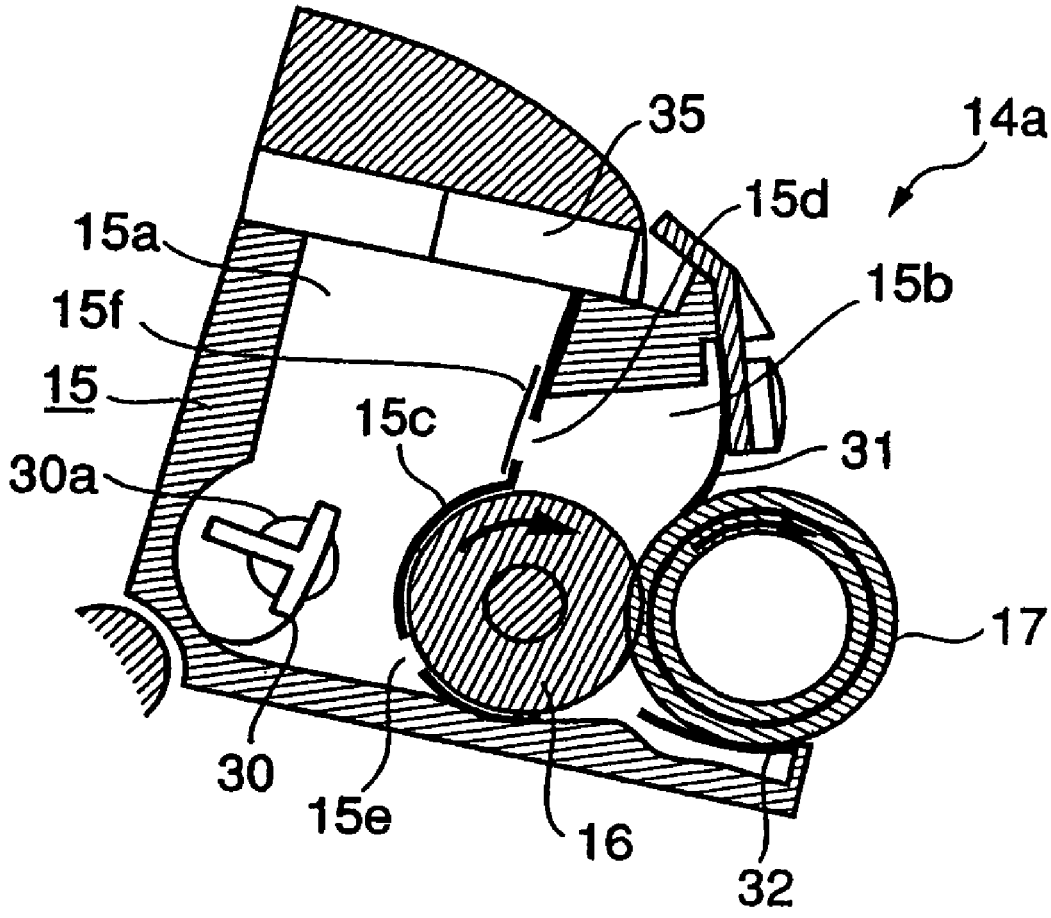
FIG. 2 is a cross sectional view of a developing apparatus of the present invention.

FIG. 2 is a cross sectional view of BK developing unit 14*a* (which is the same as developing units 14*b* through 14*d*). The developing apparatus is divided into a toner container 15*a* (toner containing chamber) and a toner supply unit 15*b* (toner supply chamber, wherein a toner supply roller 16 and a developing roller 17 are provided). The toner container 15*a* is separated from the toner supply unit 15*b*, by a boundary wall

15*c* which is provided with a first opening 15*d* and a second opening 15*e* positioned under the first opening 15*d*.

The developing roller 17 faces the development position of the photoreceptor drum 11. The toner container 15*a* contains the single component toners which are stirred by a stirring member 30 which is a PET film of e.g., 40 μm fixed on a rotation axis 30*a*, whereby the single component toner is supplied from the second opening 15*e* into the toner supply unit 15*b* and is further supplied to the developing roller 17. Here, the center of the rotation axis of the stirring member 30*a* is positioned over the second opening 15*e*, in order to well stir the toner.

The developer layer (toner layer) on the developing roller 17 is regulated and electrically charged by a layer thickness regulating member 31 of, e.g., a 0.08 mm SUS foil which regulates the toner layer pressure 25 N/m, thereby developing the latent image on the photoreceptor drum 11 by the developing roller 17. There is disposed, between the developing roller 17 and the development housing 15, a seal member 32 of, e.g., conductive PE of high molecular weight supported by conductive urethane sponge, in order to guarantee a uniform contact with the developing roller 17, thereby preventing a toner leak.

When filling up the toners into the developing unit 14*a*, the developing apparatus are rotated and the developing unit 14*a* are positioned at a toner fill-up position. The toners are filled up, from a toner fill-up container 34 as shown in FIG. 1, by using a toner fill-up pipe 33 as shown in FIG. 1 which is inserted into the toner container 15*a*. As shown in FIG. 2, the toner fill-up pipe 33 is connected with a connection portion 35 in the development housing 15.

Further, there is disposed the first opening 15*d* at the toner container (15*a*) side and moreover an excessive supply prevention valve 15*f* (opening and closing member as explained later.

Further, the first opening 15*d* is positioned at the downstream direction along the rotational direction of the supply roller 16 as shown by the arrow as shown in FIG. 2 and moreover the first opening 15*d* is positioned over the uppermost edge of the supply roller 16. Further, the second opening 15*e* is positioned under the center of the rotation axis 30*a*.

Figure 3:
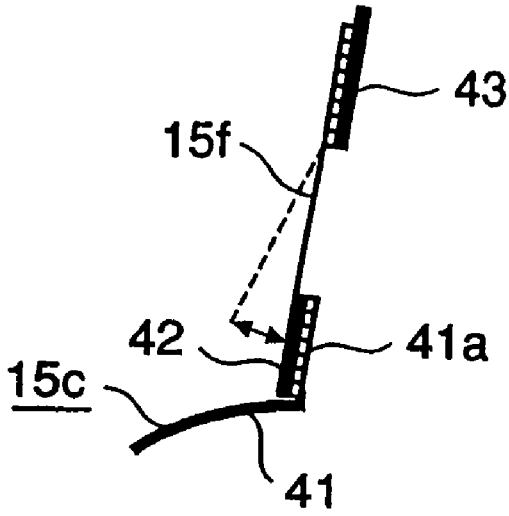
FIG. 3 is a cross sectional view of a boundary wall with an excessive supply prevention valve between the toner container and the toner supply unit.

As shown in FIG. 3, a part of the boundary wall 15*c* is of, e.g., 100 μm thick PET film 41 which is disposed along the outer surface of the toner supply roller 16 and is provided with a rib portion 41*a* which is provided at the toner container (15*a*) side and is fixed, by, e.g., a double-sided adhesive tape, with a valve seat 42 of, e.g., SUS.

A fixing member 43 of, e.g., 0.5 mm thick SUS plate, is provided over the valve seat 42. An edge of the fixing member 43 is fixed with the development housing 15. Thus, the first opening 15*d* is formed by the valve seat 42 and the fixing member 43. (The development housing comprised PET film 41 and the fixing member 43.) As shown in FIG. 3, an end of the excessive supply prevention valve 15*f* at the toner container (15*a*) side is fixed, by the two-sided adhesive tape, with the fixing member 43. Another free end of the valve 15*f* contacts the valve seat 42.

When the toner quantity supplied from the second opening 15*e* is increased, the valve 15*f* of, e.g., 50 μm thick PET film is opened by a toner pressure, whereby an excessive toner is recovered into the toner container 15*a*.

Thus, the excessive toner supply is prevented, thereby solving the obstructed toner circulation. In other words, as a result that the toner does not stagnate in the toner supply unit 15*b*, the rotational load of the supply roller 16 does not increase, the supply roller is well supplied with the toner, the toner is well electrically charged and the image quality degradation such as the background fog increase is avoided.

Further, the second opening 15*e* is formed at the upperstream side of the first opening 15*d* (i.e., the second opening 15*e* is formed under the rotational axis of the supply roller 16), the toner supplied from the second opening 15*e* into the toner supply unit 15*b* does not immediately reach the toner layer thickness regulating member 31. Accordingly, from this point of view, the image quality is not easily degraded.

Further, the PET film 41 is disposed along the outer surface of the supply roller 16 and the toner quantity supplied through the second opening 15*e* is determined by the size of the second opening 15*e* and the gap between the PET film 41 and the supply roller 16. Accordingly, a lot of the toner is not abruptly supplied into the toner supply unit 15*b*.

As explained above, such a toner size selection that smaller-sized toners are consumed first can be suppressed, thereby preventing the image quality degradation, because the excessive toner supply is suppressed. Further, it is not required to guarantee a gap between the supply roller 16 and the excessive supply prevention valve 15*f*, because the valve 15*f* is provided inside of the toner container 15*a*. Furthermore, the developing apparatus can be made smaller-sized, because the toner is supplied through the second opening 15*e*.

While we have described a preferred embodiment of the present invention, there are several modifications thereof. For example, although the excessive supply prevention valve 15*f* was a PET film, it may be of any flexible material such as resins, e.g., polyethylene, nylon, polyurethane and PTFE, silicone rubber and fluorinated elastomer. Further, it was experimentally found that the thickness of the valve 15*f* may preferably be about 0.05 mm~0.3 mm. However, the valve thickness is determined, in general, on the basis of a balance between the toner pressure and the reaction force of the valve.

Further, the valve may be opened and closed by an elastic force of sponges or coil springs, because it is enough to carry the toner through the valve only in the direction from the toner supply unit 15*b* to the toner container 15*a*.

Figure 4:
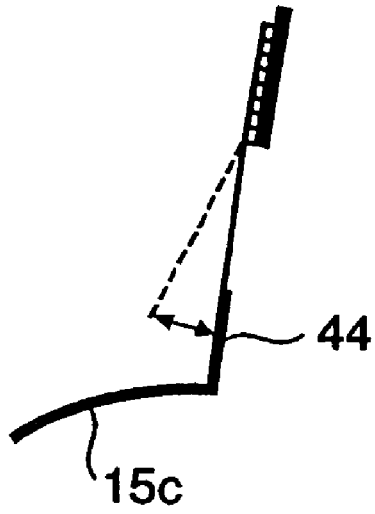
FIG. 4 is another cross sectional view of a boundary wall with another excessive supply prevention valve.

Although the lower end of the valve was made free in FIG. 3 and FIG. 4, the upper end of the valve may be made free.

Although a part of the boundary wall 15*c* was PET film 41, it may be a bent SUS plate 44 of, e.g., 0.3 mm thickness. Further, although the developing unit 14*a* through 14*d* were of the same structure, for example, only the BK developing unit may employ the single component magnetic toner. Further, although the fixing member 43 and PET film formed the boundary wall 15*c*, the boundary wall 15*c* may be a solid casting or molding product. There are provided, in the unified boundary wall 15*c*, the first opening 15*d* and the second opening 15*e*.

Furthermore, the development apparatus of the above-explained embodiment can be made further smaller.

Figure 5:
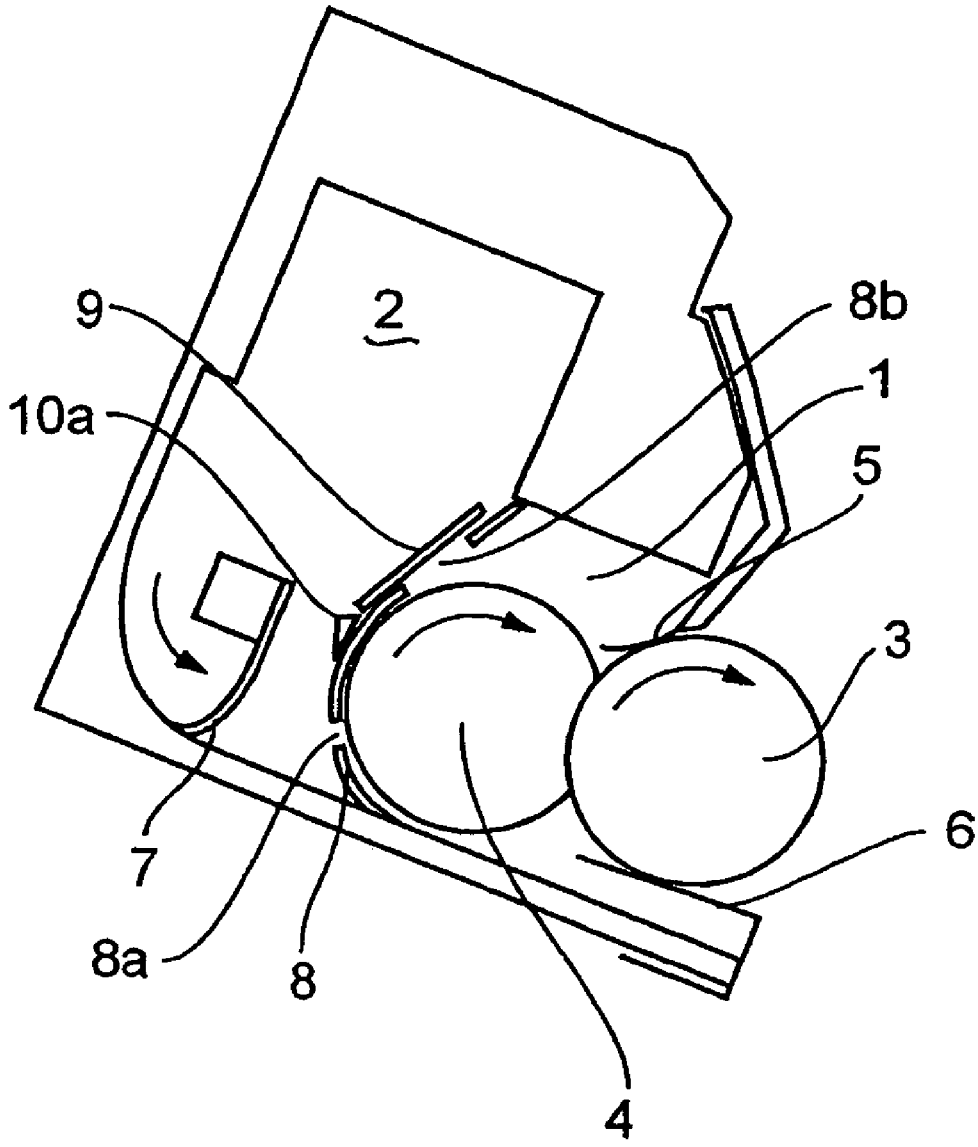
FIG. 5 is a cross sectional view of a development apparatus of another embodiment of the present invention.

FIG. 5 is a cross sectional view of a developing apparatus of another embodiment. In the developing apparatus, the boundary wall has a partial portion along an outer surface of the supply roller; the second opening is provided at the partial portion; and contact prevention means for preventing the stirring member from contacting said opening and closing member is provided at said partial portion and under said first opening and over said second opening. The contact prevention means is a projection or a step which is provided in the developer containing chamber and is projected toward an inner side of the developer containing chamber. Further, a center of the second opening is lower than a rotational axis of the supply roller; an upper end of the first opening is higher than an uppermost point of said supply roller; and a lower end of the first opening is lower than an uppermost point of said supply roller.

The developing apparatus is divided, by the boundary wall 8, into the developing unit 1 (toner supply chamber) and the toner containing chamber 2. There are provided in the developing unit a toner supply roller 4 for supplying a developing roller 3 with the toner, the regulating member 5 for regulating the toner layer thickness and for electrically charging the toner and a seal member 6 for sealing a portion where the toner after developing returns back to the developing apparatus. Here, the developing roller 3 is of JIS-A hardness 45 degree, of $10^6$ Ω order and of surface roughness Ra (arithmetic average height defined by JIS B0601-2001) 1.0 μm. The toner supply roller 4 is of, e.g., $10^5$ Ω urethane sponge. The nip between the toner supply roller 4 and the developing roller 3 is 3 mm. The regulating roller 5 is a 0.08 mm thick SUS foil. The regulating pressure of the regulating member 5 is 25 N/m. The seal member 6 is of conductive high molecular weight PE film backed-up by a formed member, in order to uniformly contact the developing roller 3.

There is provided in the toner containing chamber 2 a stirring member 7 which is a PET film of e.g., 40 μm fixed on a rotation axis and supplies the second opening 8*a* of the boundary wall 8 with the toner.

The boundary wall 8 is a 0.5 mm thick SUS plate wherein the second opening 8*a* and a first opening 8*b* are provided. The toner in the toner containing chamber 2 is supplied into the toner supply chamber 1 through the second opening. The toner quantity is regulated by the size and shape of the second opening 8*a* and by the gap between the boundary wall 8 and the toner supply roller 4, thereby avoiding the over supply. Accordingly, the toner circulation between the toner supply chamber 1 and the toner containing chamber 2 is suppressed, thereby suppressing the toner size selection.

Further, the excessive supply prevention valve 9 is a 50 μm thick PET film and is fixed with the upper portion of the first opening 8*b* at the toner containing chamber side. The first opening 8*b* is positioned over the second opening 8*a*. The valve 9 is pushed and opened by the toner pressure in the toner supply chamber 1, thereby returning back the excessive toner to the toner containing chamber 2. Accordingly, the excessive toner supply is prevented, the toner moves well in the toner supply chamber 1, the torque of the developing apparatus does not increase and the toner is electrically charged sufficiently. Further, the toner does no enter the toner supply chamber 1 through the first opening 8*b*, whereby additionally supplied toner does not immediately goes near the regulating member 5, thereby preventing the fogging due to the additional toner supply.

Further, there is provided at the lower portion of the first opening 8*b* a projection of a SUS plate which is the same material as the boundary wall 8, thereby preventing the stirring member 7 from contacting the excessive supply prevention valve 9. Accordingly, the stirring member 7 does not push up the valve 9, thereby preventing the valve damage and the torque increase. Further, the insufficient electrical charging of the toner caused by the excessive toner supply is prevented.

Figure 6:
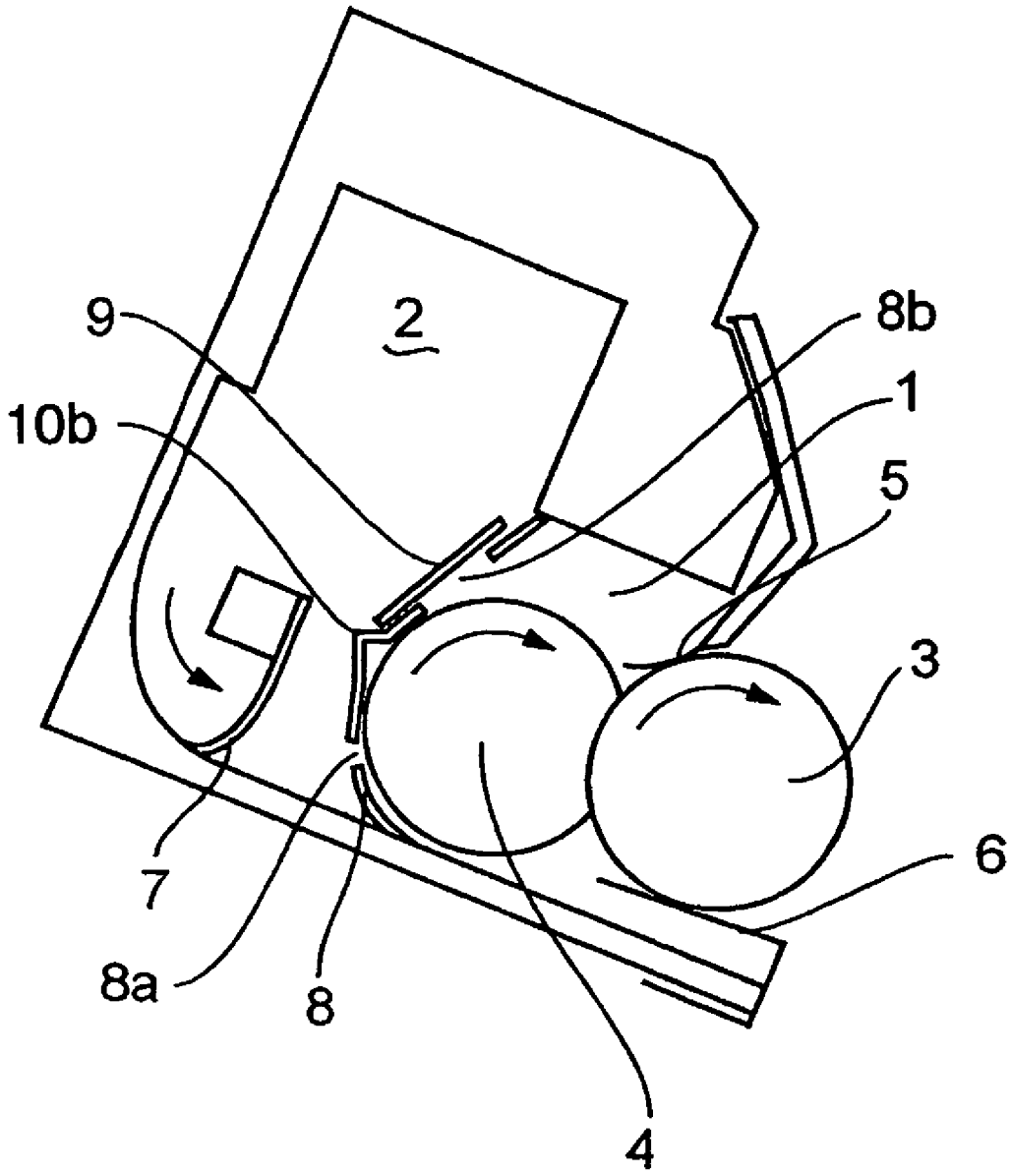
FIG. 6 is across sectional view of modified development apparatus of another embodiment of the present invention.
Figure 7:
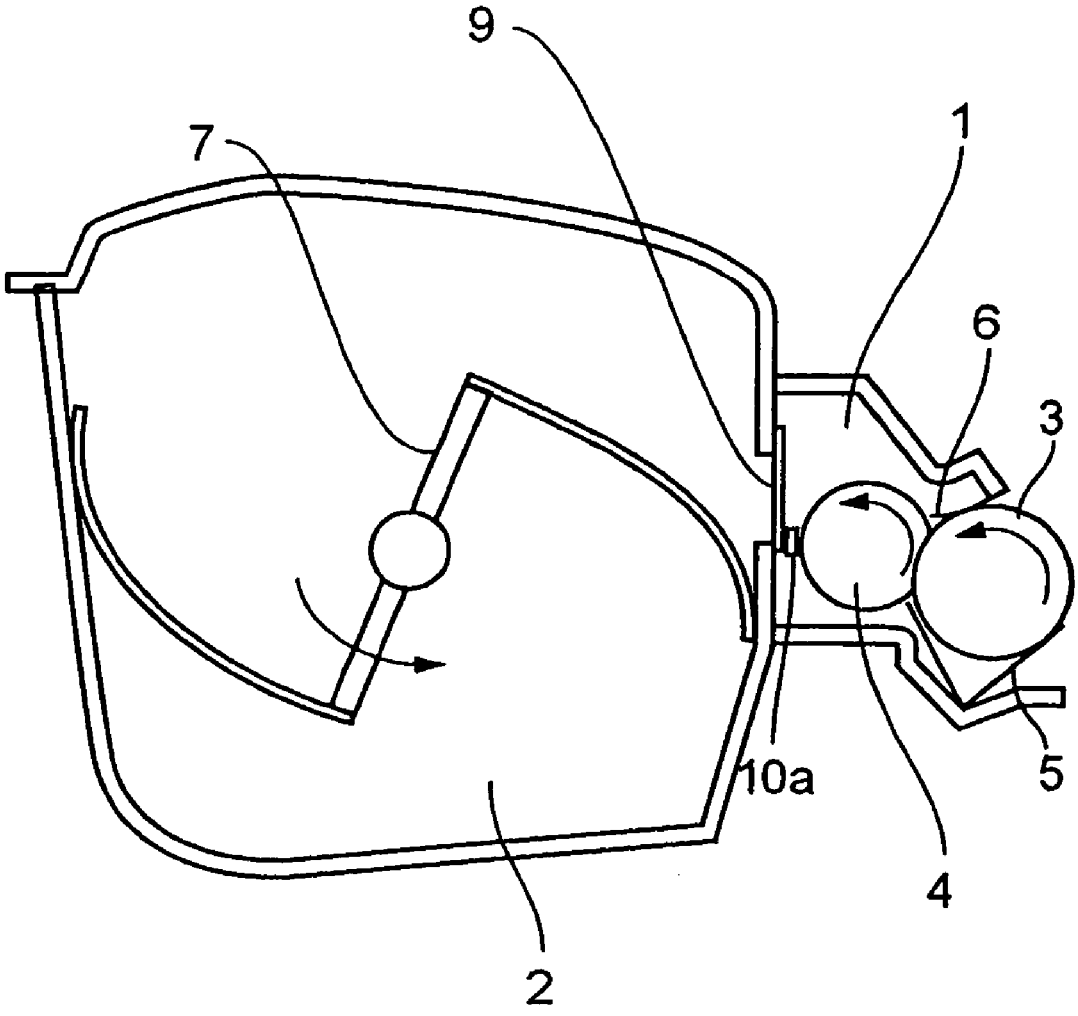
FIG. 7 is a cross sectional view of a conventional development apparatus.

Further, in place of the projection 10*a*, a step 10*b* may be provided, as shown in FIG. 6, because the step 10*b* obstructs in the contact of the stirring member 7 with the edge of the valve 9.

The single component developer is supplied, through the second opening, from the developer containing chamber into the developer supply chamber, and the opening and closing member opens and closes, in response to a developer quantity supplied into the developer supply chamber and allows the single component developer to move only in a direction from the developer supply chamber to the developer containing chamber. Therefore, the excessive toner supply into the toner supply chamber is prevented, because the opening and closing member allows the toner to return only from the toner supply chamber to the toner containing chamber, whereby the toner does not stagnate in the toner supply chamber and the image quality degradation such as the fogging can be avoided. Accordingly, the development apparatus can be applied to a small image forming apparatus.

What is claimed is:

1. A developing apparatus having one or more developing units, said developing unit comprising:

a developer containing chamber for containing a single component developer;

a developer supply chamber which is supplied with said single component developer in said developer containing chamber;

developing means which is disposed in said developer supply chamber and develops an electrostatic latent image on one or more image retaining members by said single component developer;

a boundary wall, disposed between said developer containing chamber and said developer supply chamber, which has a first and a second opening; and an opening and closing member for opening and closing said first opening;

wherein said single component developer is supplied, through said second opening, from said developer containing chamber into said developer supply chamber; and said opening and closing member opens and closes, in response to a quantity of said single component developer supplied into said developer supply chamber and allows said single component developer to move in only one direction from said developer supply chamber to said developer containing chamber;

wherein said developing means comprises a developing roller for developing said electrostatic latent image; and a supply roller for supplying said developing roller with said single component developer;

wherein said first opening is formed, relative to said second opening, at a downstream side along a rotational direction of said supply roller;

wherein said second opening is formed under a center of a rotation axis of said supply roller; and said first opening is formed over an uppermost point of an outer surface of said supply roller; and which further comprises a stirring member disposed in said developer containing chamber, wherein a center of a rotation axis of said stirring member is positioned over said second opening.

2. The developing apparatus according to claim 1, which further comprises a rotation unit for rotating said one or more developing units, wherein said one or more developing units are positioned, by said rotation unit, at a developing position which faces each of said one or more image retaining members.

3. A developing apparatus having one or more developing units, said developing unit comprising:

a developer containing chamber for containing a single component developer;

a developer supply chamber which is supplied with said single component developer in said developer containing chamber;

developing means which is disposed in said developer supply chamber and develops an electrostatic latent image on one or more image retaining members by said single component developer;

a boundary wall, disposed between said developer containing chamber and said developer supply chamber, which has a first and a second opening; and an opening and closing member for opening and closing said first opening;

wherein said single component developer is supplied, through said second opening, from said developer containing chamber into said developer supply chamber; and said opening and closing member opens and closes, in response to a quantity of said single component developer supplied into said developer supply chamber and allows said single component developer to move in only one direction from said developer supply chamber to said developer containing chamber;

wherein said developing means comprises a developing roller for developing said electrostatic latent image; and a supply roller for supplying said developing roller with said single component developer;

wherein said first opening is formed, relative to said second opening, at a downstream side along a rotational direction of said supply roller;

wherein said second opening is formed under a center of a rotation axis of said supply roller; and said first opening is formed over an uppermost point of an outer surface of said supply roller; and wherein said boundary wall has a partial portion formed along an outer surface of said supply roller and said second opening is formed at said partial portion.

4. A developing apparatus having one or more developing units, said developing unit comprising:

a developer containing chamber for containing a single component developer;

a developer supply chamber which is supplied with said single component developer in said developer containing chamber;

developing means which is disposed in said developer supply chamber and develops an electrostatic latent image on one or more image retaining members by said single component developer;

a boundary wall, disposed between said developer containing chamber and said developer supply chamber, which has a first and a second opening; and an opening and closing member for opening and closing said first opening;

wherein said single component developer is supplied, through said second opening, from said developer containing chamber into said developer supply chamber; and said opening and closing member opens and closes, in response to a quantity of said single component developer supplied into said developer supply chamber and allows said single component developer to move in only one direction from said developer supply chamber to said developer containing chamber; and wherein said opening and closing member is an elastic or flexible member disposed in said developer containing chamber; an end of said elastic or flexible member is fixed with said boundary wall; and another end of said elastic or flexible member is free.

5. A developing apparatus having one or more developing units, said developing unit comprising:

a developer containing chamber for containing a single component developer;

a developer supply chamber which is supplied with said single component developer in said developer containing chamber;

developing means which is disposed in said developer supply chamber and develops an electrostatic latent image on one or more image retaining members by said single component developer;

a boundary wall, disposed between said developer containing chamber and said developer supply chamber, which has a first and a second opening; and an opening and closing member for opening and closing said first opening;

wherein said single component developer is supplied, through said second opening, from said developer containing chamber into said developer supply chamber; and said opening and closing member opens and closes, in response to a quantity of said single component developer supplied into said developer supply chamber and allows said single component developer to move in only one direction from said developer supply chamber to said developer containing chamber; and wherein said boundary wall has a partial portion along an outer surface of said supply roller; said second opening is provided at said partial portion; and contact prevention means for preventing said stirring member from contacting said opening and closing member is provided at said partial portion and under said first opening and over said second opening.

6. The developing apparatus according to claim 5, wherein said contact prevention means is a projection or a step which is provided in said developer containing chamber and is projected toward an inner side of said developer containing chamber.

7. The developing apparatus according to claim 5 or 6, wherein:

a center of said second opening is lower than a rotational axis of said supply roller;

an upper end of said first opening is higher than an uppermost point of said supply roller; and a lower end of said first opening is lower than an uppermost point of said supply roller.

8. The developing apparatus according to claim 3, which further comprises a rotation unit for rotating said one or more developing units, wherein said one or more developing units are positioned, by said rotation unit, at a developing position which faces each of said one or more image retaining members.

* * * * *